United States Patent [19]

Humbert

[11] 4,121,440

[45] * Oct. 24, 1978

[54] FABRIC DRAW DOWN DEVICE

[75] Inventor: René Humbert, Couvet, Switzerland

[73] Assignee: Edouard Dubied et Cie. (Societe Anonyme), Switzerland

[ * ] Notice: The portion of the term of this patent subsequent to Oct. 24, 1992, has been disclaimed.

[21] Appl. No.: 422,718

[22] Filed: Dec. 7, 1973

[30] Foreign Application Priority Data

Dec. 8, 1972 [CH] Switzerland ..... 17886/72

[51] Int. Cl.[2] ..... D04B 15/90

[52] U.S. Cl. ..... 66/152

[58] Field of Search ..... 66/152, 149 R; 226/157; 74/575

[56] References Cited

U.S. PATENT DOCUMENTS 3,456,516 7/1969 Fisnar et al. ..... 74/575

FOREIGN PATENT DOCUMENTS 407,853 1/1925 Fed. Rep. of Germany ..... 66/152 UX
590,829 12/1933 Fed. Rep. of Germany ..... 74/575
629,840 4/1936 Fed. Rep. of Germany ..... 66/152 UX
970,947 11/1958 Fed. Rep. of Germany ..... 66/152
44-13,865 6/1969 Japan ..... 226/157

*Primary Examiner*—Werner H. Schroeder
*Assistant Examiner*—Andrew M. Falik
*Attorney, Agent, or Firm*—Henry L. Brinks; Peter E. Heuser

[57] ABSTRACT

A fabric draw down device for a flat knitting machine having a traction roller for tensioning fabric, retaining rollers for pressing against the traction roller and entrainment means for driving the traction roller. The entrainment means includes a pair of opposing levers which are pivotally mounted on offset axes and are drawn together with a spring. The levers each have a pawl which acts on a ratchet wheel mounted on the traction roller. A camming means moves the pair of opposing levers to alternately drive and release the ratchet wheel.

10 Claims, 4 Drawing Figures

FABRIC DRAW DOWN DEVICE

BACKGROUND OF THE INVENTION

The present invention relates to a fabric drawing device for a flat knitting machine, comprising a traction roller, an entrainment means for the latter and rollers pressed against the traction roller. The entrainment means comprises pawls coacting with a ratchet wheel mounted on a traction roller, a tensioning spring associated with the pawls to impart spring bias to the traction wheel, and a cam which acts to increase the spring tension as desired.

This type of embodiment already is known from prior art. The drawing device described in the German patent No. 407,853 uses a cam which operates a lever against the force of a traction spring. The lever supports a pawl which coacts with a ratchet wheel fastened on a roller. The cam follower is prevented from contacting the lower portions of the cam by a tension balance between the force of the spring and the tension of the fabric resisting a downward pull. When the cam acts to increase the spring tension, that is, when the follower passes over a raised portion or protuberance on the cam, the pawl is raised and advances by one tooth. During this period of time, the ratchet wheel is held in its position by a non-return pawl. A certain recoil is then inevitable. This basic principle, which underwent several improvements, still is used. Among other matters, the number of pawls was increased, each of which is of different length in order to subdivide the pitch of the ratchet wheel; fastening points of the adjustable spring were introduced in order to make possible an adjustment of the length and a division of the initial force of the spring; torsion bars were introduced betweed the ratchet wheel and the roller to equalize the transmitted torque, etc.

In conventional drawing means there are substantial fluctuations in the spring tension, thus resulting in variations in fabric tension. These fluctuations often necessitate the inclusion of torsion bars which increase the cost of these mechanisms.

The regularity of the stitches and thus the good quality of the knitted goods is a function of the regularity of the traction exerted on the fabric. Thus, it is understandable that the drawing devices are a subject of continuous research.

OBJECTS AND SUMMARY OF THE INVENTION

The objective of the invention is to equalize the traction force, to avoid the recoil and to simplify the design.

In the device for drawing according to the invention, two levers, whose pivoting axes are offset in relation to each other, are pulled against each other by the spring, spaced from each other separately by the cam and each is provided with at least one pawl which coacts with the ratchet wheel.

The attached drawing exemplifies an embodiment of the drawing device according to the invention.

DESCRIPTION OF THE PREFERRED EMBODIMENTS

Figure 2:
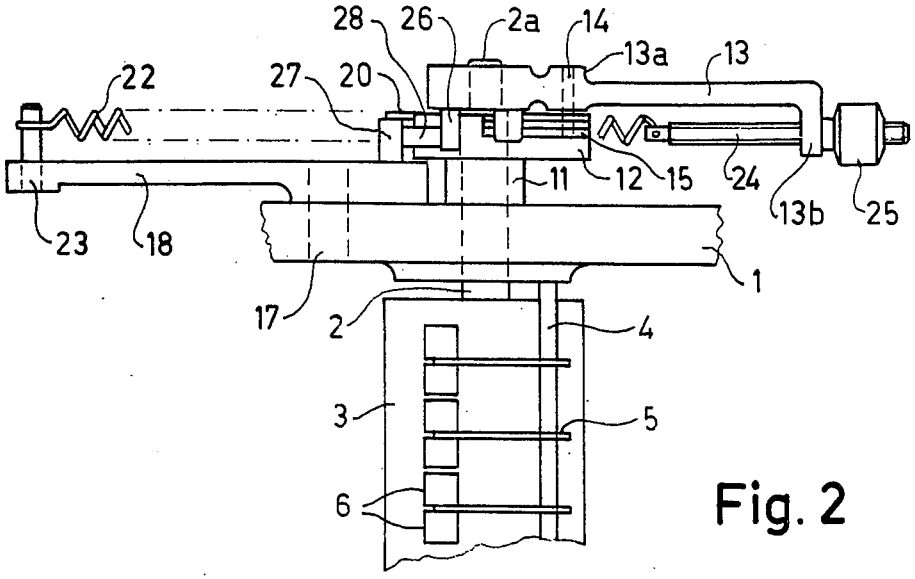
FIG. 2 is a view from the bottom.

The wall 1 is fastened on the frame of the knitting machine. It bears a shaft to which the traction roller 3 is fixed. The bearing plate supports a shaft 4 on which roller supports 5 are mounted which support retaining rollers 6 pressed against the traction roller 3 by springs 39. The fabric 7 drops down from the needle beds 8, 9, represented by dots and dashes. The fabric passes between the traction roller 3 and the retaining rollers 6 and is pulled in the direction of the arrow 10 toward the bottom of the machine, by the traction roller 3. The retaining rollers 6 are entrained by the fabric and press the latter against the traction roller 3. It is entrained by an entrainment means which is described below.

A spacing bushing 11 and the ratchet wheel 12 are fastened to the shaft 2. The lever 13 is pivotally mounted on the end of the shaft 2. A stud 14 is chased into a protuberance **13*a* of the lever. This stud supports three pawls 15*a*, *b* and *c* which can pivot on the stud and which are pressed against the ratchet wheel 12 by the compression spring 16. The three separate pawls 15*a*, *b* and *c* have only been shown in FIG. 4. Alternatively, a single pawl 15** may be utilized as shown in the remainder of these FIGURES.

A stud 17 whose axis is shifted in relation to the axis of the shaft 2 is fastened in the bearing plate 1. The lever 18 is pivotally mounted on it. A stud 19 is chased into this lever 18. This stud 19 supports the three pawls **20*a*, *b* and *c* pawls 20 which can pivot on it and are pressed against the ratchet wheel 12 by the compression springs 21. The three separate pawls 20*a*, *b* and *c* have only been shown in FIG. 4. Alternatively, a single pawl 20** may be utilized as shown in the remainder of these FIGURES.

The two levers 13 and 18 are drawn against each other by the traction spring 22. This spring is hooked by one of its loops to the eyebolt 23, the latter being chased into the end **18*a* of the lever 18. The other loop of the spring 21 is hooked to an adjustment screw 24. The latter crosses an elbowed support 13*b*, located at the end of the lever 13. The adjustment screw 24 bears a nut 25 which bears down on the elbowed support 13*b*. By turning the nut 25, the length of the part of the adjustment screw 24 is changed which crosses the elbowed support, and thereby the length of spring 22** is modified. That way, the force with which both levers are pulled toward each other is changed.

Figure 3:
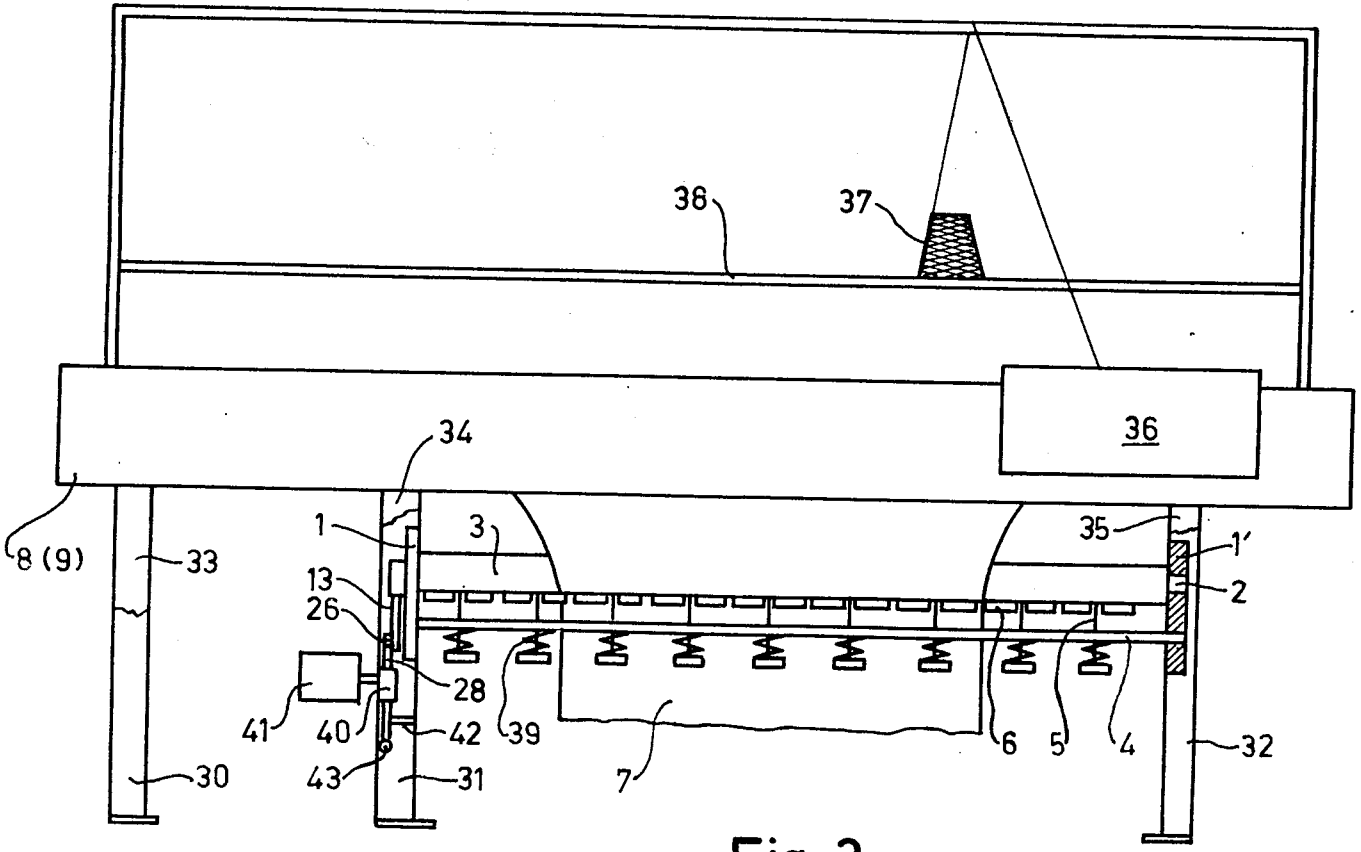
FIG. 3 is a front view of a knitting machine.

The lever 13 is provided with a lug 26 and lever 18 with a lug 27. The arm 28 of one lever is located between both lugs 26 and 27. During the knitting, this lever continuously carries out an oscillating movement along arrow 29, of the same amplitude, for which it is entrained by a cam 40 (FIG. 3); This arm 28, through the oscillation caused by the cam 40, acts to increase the tension in the spring 22 by separating the lugs 26 and 27 and the levers 13 and 18 connected thereto. This spreading of the levers causes the ends of the spring 22 to become further separated, thus increasing the spring tension.

Figure 4:
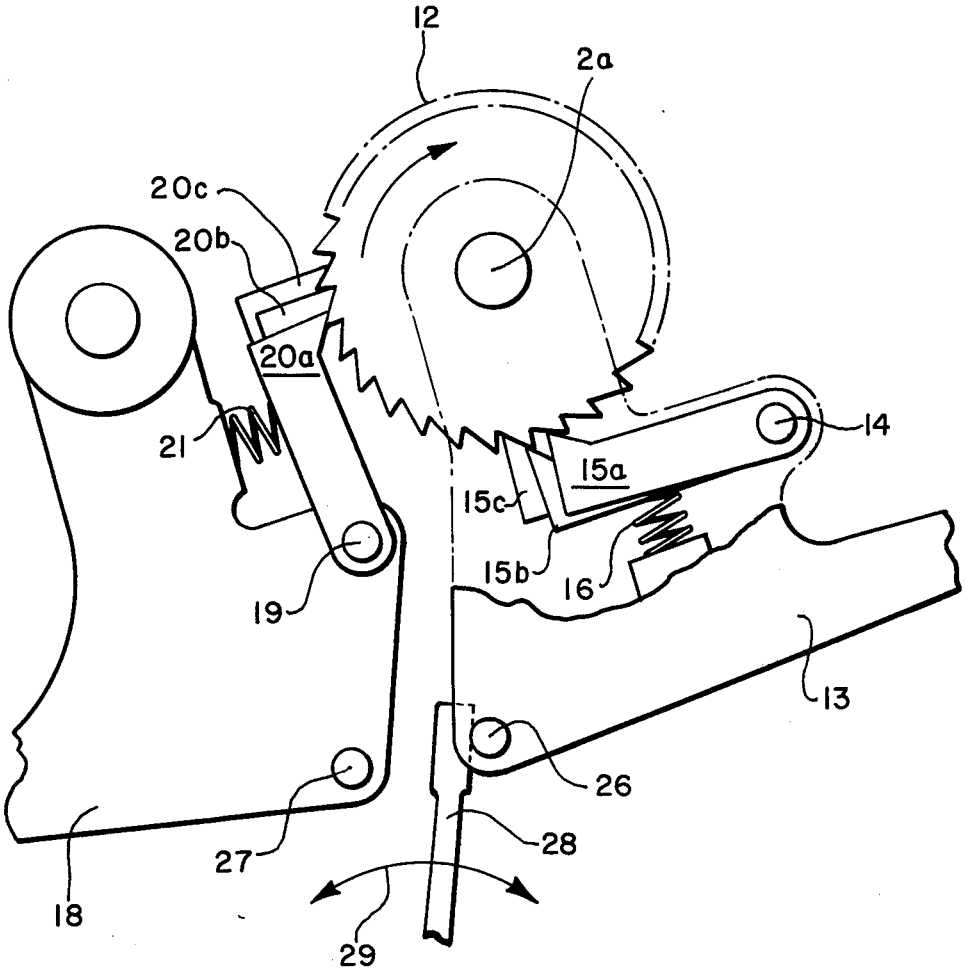
FIG. 4 is a front view of the draw down mechanism showing the levers in a spread position.

FIG. 4 depicts the use of three pawls mounted to each of the studs 14 and 19. The pawls **15*a*, *b* and *c* and 20*a*, *b* and *c*** are of staggered length to minimize backlash and refine the advance and feeding of the fabric, thereby making the apparatus more operational. The use of multiple pawls also minimizes the stress in any one pawl, and allows sufficient tooth size to ensure sufficient traction force.

The drawing device operates in the following manner: The oscillating arm 28 spreads both levers 13, 18 according to the amplitude of its movement. This spreading causes the lever 13 and its pawl 15 to shift counterclockwise around its pivot 2*a* (which is the end portion of the shaft 2), and causes lever 18 and its pawl 20 to shift counterclockwise around its pivot (stud 17). Pawls 15 and 20 are allowed to slip over the ratchet wheel due to the configuration of the ratchet teeth. Once the levers are spread, their pawls engage into the teeth of the ratchet wheel. The pawls then hold the levers spread, while exerting a thrusting force on the ratchet wheel. This force is proportional to the preadjusted tension of the spring 22. It creates a torque in the ratchet wheel, said torque being transmitted via shaft 2 to the traction roller 3, where a traction force is created on the fabric. When a row of stitches is produced between the needlebeds 8,9, the fabric drops slightly, thus reducing the resistance offered against the traction roller. The traction roller, urged by spring 22 across the levers 13,18 and their pawls, turns slightly in a clockwise direction as the fabric drops. The spring tension insures that pawls move with the rotation of the traction roller, thus causing levers 13 and 18 to move toward each other, pivoting in a clockwise and counterclockwise direction, respectively. The arm 28 then oscillates to spread the lugs 26 and 27, thus restoring the preadjusted tension and the desired tension on the fabric, and the cycle is repeated.

The length of the fabric produced between two oscillations of the arm 28 being very small, the oscillating movements of both levers 13 and 18 likewise is very small, so that the length of the spring 22 is almost unchanged. Its traction force thus remains practically constant, which is translated into a very constant traction on the fabric.

FIG. 3 shows a knitting machine from which we removed a few parts to show the fabric drawing device more clearly.

This machine is composed of needlebeds 8 and 9 (FIG. 1) held by rear legs 30, 31, 32 and front legs 33, 34, 35, of a knitting carriage 36, coils 37 and a coil or bobbin holder 38. The bearing plate 1 is fastened between the rear leg 31 and the front leg 34. A bearing plate 1 is fastened between the rear leg 32 and the front leg 35.

Shafts 2 and 4 are located in these bearing plates 1 and 1'. The fabric 7 passes between the pulling roller 3 and the retaining rollers 6. The retaining rollers 6, carried by the roller supports 5 are pressed against the traction roller 3 by the springs 39, for example, according to the German Pat. No. 629,840.

Figure 1:
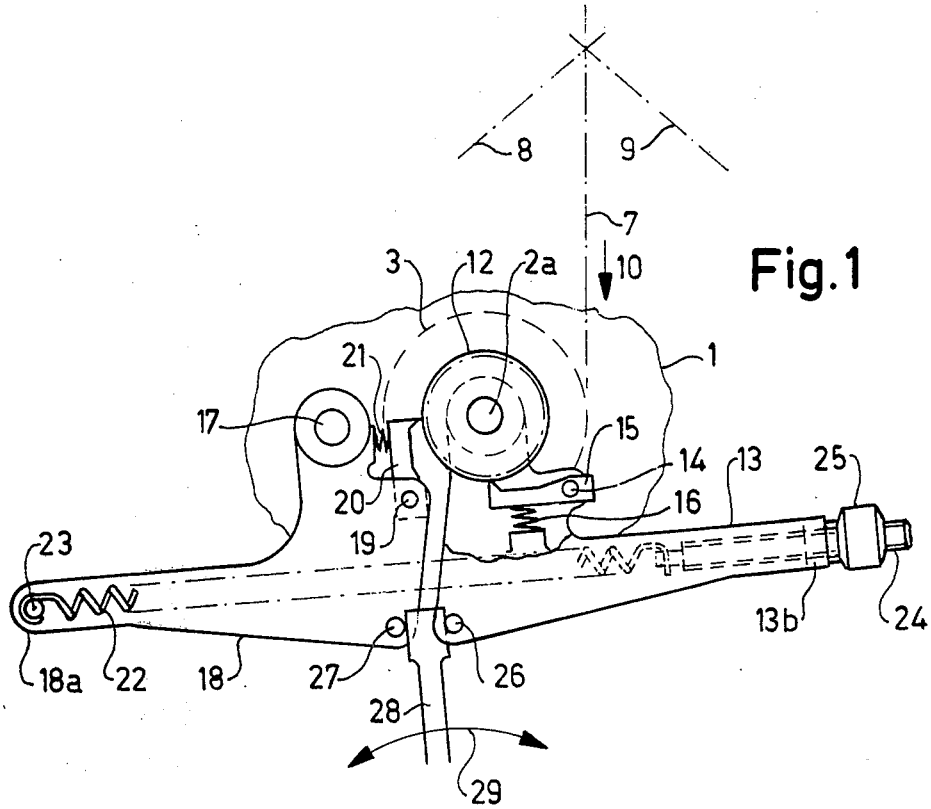
FIG. 1 is a front view.

The oscillating movement of the arm 28, may, for example, be generated by the rotation of an eccentric cam 40 placed in the plane of the movement of arm 28 and be entrained by an electric motor 41. The arm 28 pivots on a shaft 42, perpendicular to the movement plane and is maintained in contact with the cam 40 by a spring 43, stretched between the rear leg 31 and the end of the arm 28 remote from the lugs 26,27 (FIG. 1). Thus, the eccentric cam 40, which contacts the arm 28 between the pivot shaft 42 and the end of the arm in contact with the levers 13 and 18, acts to oscillate the shaft 28 and thereby regulate the tension on the fabric.

What is claimed is:

1. A fabric drawing device for a flat knitting machine comprising a traction roller for tensioning fabric, retaining rollers for pressing against the traction roller and entrainment means for driving the traction roller, the improvement in said entrainment means comprising:

a ratchet wheel mounted on said traction roller;

a pair of levers arranged in opposition to one another, each of said levers being coupled to pivot about an axis, the pivotal axes of said levers being offset one from the other, each of said levers having at least one pawl associated therewith for acting on said ratchet wheel;

spring means for drawing said levers together; and camming means for moving said pair of opposing levers.

2. The fabric drawing device of claim 1 wherein said camming means includes an actuating lever mounted for oscillating movement, said actuating lever extending between said pair of opposing levers.

3. The fabric drawing device of claim 2 wherein said actuating lever is pivotally mounted and said camming means includes a rotatable cam, said rotatable cam acting upon said actuating lever.

4. The fabric drawing device of claim 3 wherein said camming means includes means for biasing said actuating lever against said rotatable cam.

5. The fabric drawing device of claim 3 wherein said camming means includes means for driving said rotatable cam.

6. The fabric drawing device of claim 5 wherein said pair of opposing levers each has a plurality of pawls associated therewith for acting on said ratchet wheel.

7. The fabric drawing device of claim 1 wherein said camming means includes a rotatable cam for driving said pair of opposing levers.

8. The fabric drawing of claim 7 wherein said camming means includes means for driving said rotatable cam.

9. The fabric drawing device of claim 1 wherein said pair of opposing levers each has a plurality of pawls associated therewith for acting on said ratchet wheel.

10. The fabric drawing device of claim 1 wherein said pair of opposing levers each has lug means for engaging said camming means.

* * * * *